US006362148B1

(12) United States Patent
Durbut et al.

(10) Patent No.: US 6,362,148 B1
(45) Date of Patent: Mar. 26, 2002

(54) ANTI-LIME SCALE CLEANING COMPOSITION COMPRISING POLYOXYETHYLENE OXIDE POLYCARBOXYLIC ACID COPOLYMER

(75) Inventors: Patrick Durbut, Verviers; Guy Broze, Grace-Hollogne, both of (BE)

(73) Assignee: Colgate-Palmolive Co., Piscataway, NJ (US)

( * ) Notice: Subject to any disclaimer, the term of this patent is extended or adjusted under 35 U.S.C. 154(b) by 0 days.

(21) Appl. No.: 09/947,892

(22) Filed: Sep. 6, 2001

(51) Int. Cl.[7] ..... C11D 17/00

(52) U.S. Cl. ..... 510/238; 510/247; 510/475; 510/477; 510/482

(58) Field of Search ..... 510/238, 247, 510/475, 476, 477, 482

(56) References Cited

U.S. PATENT DOCUMENTS 6,034,046 A * 3/2000 Blanvalet et al. ..... 51/362

FOREIGN PATENT DOCUMENTS

| | | | |
|---|---|---|---|
| EP | 875552 | * | 6/1983 |
| EP | 875554 | * | 7/1983 |
| EP | 875555 | * | 7/1983 |

* cited by examiner

*Primary Examiner*—Necholus Ogden
(74) *Attorney, Agent, or Firm*—Richard E. Nanfeldt

(57) ABSTRACT

An anti-lime scale cleaning composition containing at least a surfactant, excluding cationic surfactants, a polyethylene oxide polycarboxylic acid copolymer and water.

5 Claims, No Drawings

ANTI-LIME SCALE CLEANING COMPOSITION COMPRISING POLYOXYETHYLENE OXIDE POLYCARBOXYLIC ACID COPOLYMER

FIELD OF THE INVENTION

The present invention relates to an anti-lime scaling and anti-soap scum cleaning composition for ceramic surfaces, wherein the composition includes a surfactant, excluding cationic surfactants, a hydrophilizing polyethylene oxide polycarboxylate copolymer and water.

BACKGROUND OF THE INVENTION

Numerous cleaning compositions have been disclosed in various patents. However, a major problem with these cleaning compositions is that limescale and soap scum are not effectively removed from the surface being treated. Cleaning compositions known in the art for effectively removing limescale deposits are acidic compositions. It is also known in the art that the prevention of limescale formation and soap scum buildup on hard surfaces can be achieved by using chelating or sequestering agents in alkaline liquid cleaning compositions.

EP-0875555 discloses the use of a polysaccharide polymer or a mixture thereof in a liquid acidic composition for treating a hard-surface, to reduce the formation of limescale deposits on the surface when it comes in contact with water. The liquid composition has a pH below 4.

EP-0875554 teaches the use of an acid-stable polymer selected from the group consisting of a polycarboxylate, a sulphonated polystyrene polymer, a vinylpyrrolidone homo/copolymer, a polyalkoxylene glycol, and mixture thereof, in a liquid acidic composition having a pH below 5. Said acidic compositions are suitable for removing limescale-containing stains from a hard-surface.

EP-0983294 describes a liquid composition having a pH of from 7 to 14 for cleaning hard surfaces, comprising a homo or copolymer of vinylpyrrolidone and a polysaccharide polymer. However, no liquid neutral pH compositions as described in the present invention comprising a polyalkylene oxide polycarboxylate copolymer are disclosed therein.

U.S. Pat. No. 6,034,046 discloses the use of an agent for the prevention of soap scum buildup, wherein said agent is selected from the group consisting of a trisodium salt of methyl glycine diacetic acid, a polyaspartic acid, imino disuccinic acid sodium salt and glutamic acid-N,N-diacetic acid sodium salt. Another agent described in U.S. Pat. No. 6,034,046 which can be used for the prevention of soap scum buildup is a sodium salt of a copolymer of maleic anhydride and an olefin. However, no liquid neutral pH compositions as described in the present invention comprising a polyalkylene oxide polycarboxylate copolymer are disclosed therein.

SUMMARY OF THE INVENTION

The present invention relates to an anti-lime scaling cleaning composition which comprises a surfactant selected in the group consisting of zwitterionic surfactants, anionic surfactants or mixtures thereof and a hydrophilizing polyethylene oxide polycarboxylate copolymer and water, wherein the composition does not contain cationic surfactants, nonionic surfactants containing ethoxylate groups, silicon containing polymer, amino containing polymers, copolymers of polyvinyl pyrrolidone or polyvinyl pyrridine N-oxide polymers.

It is an object of the instant invention to provide an anti-lime scale cleaning composition, wherein the hydrophilizing polymer renders the treated surface hydrophilic such that the contact angle of water on the treated surface is less than 40°, more preferably less than 30°.

A further object of the instant invention is to provide an anti-lime scale cleaning composition which renders the treated surface free of streaks, smear and spots, after the surface has been treated with the cleaning composition and subsequently dried.

DETAILED DESCRIPTION OF THE INVENTION

The present invention relates to a ceramic cleaning composition which renders the surface being treated hydrophilic and free of limescale, wherein the composition comprises approximately by weight:

(a) 0.01% to 10%, more preferably 0.1% to 5% of at least a surfactant, excluding cationic surfactants;

(b) 0.01% to 5%, more preferably 0.1% to 2% of a hydrophilizing polymer which is a polyethylene oxide polycarboxylate copolymer;

(c) 0.1% to 10% of a water-mixable cosurfactant having either limited ability or substantially no ability to dissolve oily or greasy soil; and (d) the balance being water, wherein the composition does not contain an amino containing polymer, a silicon containing polymer, a nonionic surfactant containing ethoxylate groups, a copolymer of polyvinyl pyrrolidone or polyvinyl pyrridine N-oxide polymers.

The surfactant used in the present invention is selected from the group consisting of zwitterionic surfactants, anionic surfactants or mixtures thereof. The zwitterionic surfactant used is a water soluble betaine having the general formula

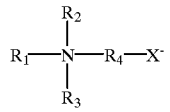

wherein $X^-$ is selected from the group consisting of $COO^-$ and $SO_3^-$ and $R_1$ is an alkyl group having 10 to about 20 carbon atoms, preferably 12 to 16 carbon atoms, or the amido radical:

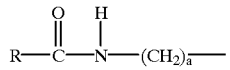

wherein R is an alkyl group having about 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyidimethyl betaines include decyl dimethyl betaine or 2-(N-decyl-N, N-dimethyl-ammonia) acetate, coco dimethyl betaine or 2-(N-coco N, N-dimethylammonia) acetate, myristyl dimethyl betaine, palmityl dimethyl betaine, lauryl dimethyl betaine, cetyl dimethyl betaine, stearyl dimethyl betaine, etc. The amidobetaines similarly include cocoamidoethylbetaine, cocoamidopropyl betaine and the like. The amidosulfobetaines include cocoamidoethylsulfobetaine, cocoamidopropyl sulfobetaine and the like. A preferred betaine is coco ($C_8$–$C_{18}$) amidopropyl dimethyl betaine. Three preferred betaine surfactants are Empigen BS/CA from Albright and Wilson, Rewoteric AMB 13 and Goldschmidt Betaine L7.

The anionic sulfonate surfactants which may be used in the composition of this invention are water soluble and include the sodium, potassium, ammonium and ethanolammonium salts of linear $C_8$–$C_{16}$ alkyl benzene sulfonates; $C_{10}$–$C_{20}$ paraffin sulfonates, $C_8$–$C_{18}$ alkyl sulfates, ethoxylated alkyl ether sulfates and mixtures thereof. The preferred anionic sulfonate surfactant is an alkyl ethoxylated alkyl ether sulfate surfactant.

The paraffin sulfonates may be monosulfonates or di-sulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains. Paraffin sulfonates that have the sulfonate group(s) distributed along the paraffin chain are described in U.S. Pat. Nos. 2,503,280; 2,507,088; 3,260,744; and 3,372,188; and also in German Patent 735,096. Such compounds may be made to specifications and desirably the content of paraffin sulfonates outside the $C_{14-17}$ range will be minor and will be minimized, as will be any contents of di- or poly-sulfonates.

Examples of suitable other sulfonated anionic detergents are the well known higher alkyl mononuclear aromatic sulfonates, such as the higher alkylbenzene sulfonates containing 9 to 18 or preferably 9 to 16 carbon atoms in the higher alkyl group in a straight or branched chain, or $C_{8-15}$ alkyl toluene sulfonates. A preferred alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 carbon atoms.

The $C_{8-18}$ ethoxylated alkyl ether sulfate surfactants have the structure $$R—(OCH_2CH_2)_nOSO_3^-M^+$$

wherein n is about 1 to about 22 more preferably 1 to 3 and R is an alkyl group having about 8 to about 18 carbon atoms, more preferably 12 to 15 and natural cuts, for example, C12–14 or $C_{12-16}$ and M is an ammonium cation or a metal cation, most preferably sodium.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3 EO) sulfate.

Ethoxylated C8–18 alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol. The ethoxylated alkyl ether sulfate is present in the composition at a concentration of 0 to about 10 wt. %, more preferably about 0.1 wt. % to 5 wt. %.

Suitable cosurfactants for the compositions of this invention are water-soluble $C_3$–$C_4$ alkanols, polyethylene glycols of the formula $HO(CH_2CH_2O)nH$ wherein n is about 8 to about 14, polypropylene glycol of the formula $HO(CH_3CHCH_2O)_nH$ wherein n is a number from 2 to 18 and copolymers of ethylene oxide and propylene oxide and mono $C_1$–$C_6$ alkyl ethers and esters of ethylene glycol and propylene glycol having the structural formulas $R(X)_nOH$ and $R_1(X)_nOH$ wherein R is $C_1$–$C_6$ alkyl, $R_1$ is $C_2$–$C_4$ acyl group, X is $(OCH_2CH_2)$ or $(OCH_2(CH_3)CH)$ and n is a number from 1 to 4.

Representative members of the polypropylene glycol include dipropylene glycol and polypropylene glycol having a molecular weight of 200 to 1000, e.g., polypropylene glycol 400. Other satisfactory glycol ethers are ethylene glycol monobutyl ether (butyl cellosolve), diethylene glycol monobutyl ether (butyl carbitol), propylene glycol monomethyl ether, dipropylene glycol monomethyl ether, triethylene glycol monobutyl ether, mono, di, tripropylene glycol monobutyl ether, tetraetylene glycol monobutyl ether, mono, di, tripropylene glycol monomethyl ether, ethylene glycol monohexyl ether, diethylene glycol monohexyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monopropyl ether, triethylene glycol monoethyl ether, triethylene glycol monomethyl ether, triethylene glycol monopentyl ether, triethylene glycol monohexyl ether, mono, di, tripropylene glycol monopropyl ether, mono, di, tripropylene glycol monoethyl ether, mono, di, tripropylene glycol monopentyl ether, mono, di, tripropylene glycol monohexyl ether, mono, di, tributylene glycol monomethyl ether, mono, di, tributylene glycol monohexyl ether, mono, di, tributylene glycol monopropyl ether, mono, di, tributylene glycol monoethyl ether, mono, di, tributylene glycol monopentyl ether, mono, di, tributylene glycol monobutyl ether, ethylene glycol monoacetate and dipropylene glycol propionate.

The hydrophilizing polymer used in the instant compositions is a polyethylene oxide polycarboxylic acid copolymer having the structure of:

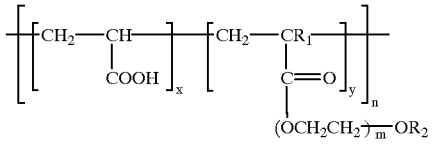

wherein $R_1$ is H or methyl group, $R_2$ is H or an alkyl group having from 1 to 4 carbons and preferably 1 carbon, the ratio of x to y is about 8:1 to 10:1, preferably 9:1, m is about 80 to 100, preferably about 90, the weight ratio of polycarboxylate to polyethylene oxide side chains is about 20/80 and the molecular mass is about 90,000 to about 110,000, more preferably about 100,000. A preferred copolymer is an acrylic acid-polyethylene glycol monomethyl ether monomethacrylate copolymer sold by BASF as Sokalan HP80.

The zwitterionic surfactant, the anionic surfactant, or mixtures thereof, and the hydrophilizing polyethylene oxide polycarboxylic acid copolymer are solubilized in the water. To the composition can also be added water soluble hydrotropic salts which include sodium, potassium, ammonium and mono-, di- and triethanolammonium salts. While the aqueous medium is primarily water, preferably said solubilizing agents are included in order to control the viscosity of the liquid composition and to control low temperature cloud clear properties. Usually, it is desirable to maintain clarity to a temperature in the range of 5° C. to 10°C. Therefore, the proportion of solubilizer generally will be from 1% to 15%, preferably 2% to 12%, most preferably 2% to 8%, by weight of the detergent composition with the proportion of ethanol, when present, being 5% of weight or less in order to provide a composition having a flash point above 46° C. Preferably the solubilizing ingredient will be a mixture of ethanol and either sodium xylene sulfonate or sodium cumene sulfonate or a mixture of said sulfonates or ethanol and urea. Inorganic salts such as sodium sulfate, magnesium sulfate, sodium chloride and sodium citrate can be added at concentrations of 0.5 to 4.0 wt. % to control the haze of the resultant solution. Magnesium salt can be used with formulations at neutral or acidic pH since magnesium hydroxide will not precipitate at these pH levels. Various other ingredients such as urea at a concentration of 0.5 to 4.0 wt. % or urea at the same concentration of 0.5 to 4.0 wt. % can be used as solubilizing agents. Other ingredients which have been added to the compositions at concentrations of 0.1 to 4.0 wt. % are perfumes, sodium bisulfite, ETDA and HETDA. The foregoing solubilizing ingredients also facilitate the manufacture of the inventive compositions because they tend to inhibit gel formation.

The liquid compositions of the present invention have a pH of about 6 to about 8, more preferably about neutral. Thus, they may comprise as an optional ingredient a source of acidity or alkalinity for the purpose of pH adjustment. Suitable sources of acidity for use herein are sulfuric acid and hydrochloric acid. Suitable sources of alkalinity for use herein are the caustic alkalis such as sodium hydroxide or potassium hydroxide.

In addition to the previously mentioned essential and optional constituents of the light duty liquid detergent, one may also employ normal and conventional adjuvants, provided they do not adversely affect the properties of the detergent. Thus, there may be used various coloring agents and perfumes; ultraviolet light absorbers such as the Uvinuls, which are products of GAF Corporation; sequestering agents such as ethylene diamine tetraacetates; magnesium sulfate heptahydrate; pearlescing agents and opacifiers; pH modifiers; etc. The proportion of such adjuvant materials, in total will normally not exceed 15% of weight of the detergent composition, and the percentages of most of such individual components will be a maximum of 5% by weight and preferably less than 2% by weight. Sodium formate can be included in the formula as a perservative at a concentration of 0.1 to 4.0%. Sodium bisulfite can be used as a color stabilizer at a concentration of 0.01 to 0.2 wt. %. The instant compositions are readily made by simple mixing methods from readily available components which, on storage, do not adversely affect the entire composition.

The instant composition liquids are readily made by simple mixing methods from readily available components which, on storage, do not adversely affect the entire composition.

The following examples illustrate liquid cleaning compositions of the described invention. The exemplified compositions are illustrative only and do not limit the scope of the invention. Unless otherwise specified, the proportions in the examples and elsewhere in the specification are by weight.

EXAMPLE 1

The following formulas were prepared at room temperature by simple liquid mixing procedures, using the following materials:

CAPB: Cocoamidopropyl dimethyl betaine sold by Albright and Wilson as Empigen BS/CA.

AEOS.2EO: Alcohol ethoxy sulfate, bearing two ethoxy groups on average., sold by Stepan as Steol 23-2S/70CIT.

Gluta.: Glutamic acid-N,N-diacetate, sodium salt.

Acusol 460NK: Copolymer of maleic anhydride and olefin sold by Rhom and Haas.

Sokalan HP80: Polyethylene oxide polycarboxylic acid copolymer from BASF.

PGNBE: Propylene glycol mono n-butyl ether.

| | A | B | C | D | E | F | G |
|---|---|---|---|---|---|---|---|
| CAPB | 1.0 | 1.0 | 1.0 | 1.0 | 1.0 | 1.0 | 0.5 |
| AEOS.2EO | — | — | — | — | — | — | 0.5 |
| Gluta. | 1.0 | — | — | — | — | — | — |
| Acusol 460NK | 1.0 | 1.0 | 1.0 | — | — | — | — |
| Sokalan HP80 | — | 1.0 | 6.0 | 2.0 | 1.5 | 1.0 | 1.0 |
| PGNBE/Ethanol (50/50) mix | 3.0 | 3.0 | 3.0 | 3.0 | 3.0 | 3.0 | 3.0 |
| Water | Bal. | Bal. | Bal. | Bal. | Bal. | Bal. | Bal. |
| pH | 11.0 | 10.5 | 8.0 | 7.0 | 7.0 | 7.0 | 7.0 |

Soap scum prevention tests were performed on Samples A to F. Composition A is used as reference composition, which contains active ingredients disclosed in U.S. Pat. No. 6,034,046. The test procedure is as follows. A tested composition is first sprayed on (15×15 cm) white ceramic tiles put on a vertical device, at a distance of about 30 cm, using a trigger. Four trigger strokes are used for delivering an appropriate quantity of tested composition on the tile surface. Treated tile is let dry for 15 minutes at room temperature. On treated ceramic tile, a 0.2M solution of calcium chloride is sprayed (one trigger stroke), and immediately after a 0.08M sodium oleate solution containing 0.05g/l of a red dye is further sprayed (four trigger strokes), for forming a soap scum film on said ceramic tile, still held vertically. Then, soap scum covered tile is immediately sprayed with the tested composition at a distance of about 30 cm. Four trigger strokes are used to deliver an appropriate quantity of tested composition on each soap scum covered tile. The whole four-step cycle [spraying of tested composition, spraying of calcium chloride solution, spraying of sodium oleate solution, and finally spraying of the tested composition again] is repeated five times. A visual assessment of soap scum prevention ability of tested composition is done, using a 1 to 10 scale. Lowest score 1 is for a tile entirely covered with red film of soap scum buildup, and corresponds to no prevention properties, while 10 score is ascribed to composition which makes the red soap scum film disappearing, leaving the tile clean and white. Intermediate scores are used when observation of intermediate tile surface coverage by soap scum. Tap water having a water hardness of 350 ppm is used as control in the same test conditions as described above.

| | A | B | C | D | E | F | Control |
|---|---|---|---|---|---|---|---|
| pH | 11.0 | 10.5 | 8.0 | 7.0 | 7.0 | 7.0 | 7.0 |
| Soap scum prevention test | 9 | 7 | 7 | 9 | 9 | 9 | 3 |

From the results presented in Example 1, it can be seen that composition B is not as effective for the prevention of soap scum deposit on ceramic tile surface as reference composition A. Composition D achieves same performance than reference composition A, while having a neutral pH rather than an alkaline pH. Compositions E and F show also excellent soap scum prevention properties at lower active ingredient content that reference composition A.

EXAMPLE 2

The following formulas were prepared at room temperature by simple liquid mixing procedures, using the following materials:

CAPB: Cocoamidopropyl dimethyl betaine sold by Albright and Wilson as Empigen BS/CA.

AEOS.2EO: Alcohol Ethoxy Sulfate, bearing two ethoxy groups on Average, sold by Stepan as Steol 23-2S/70CIT.

Gluta.: Glutamic acid-N,N-diacetate, sodium salt.

Acusol 460NK: Copolymer of maleic anhydride and olefin sold by Rhom and Haas.

Sokalan HP80: Polyethylene oxide polycarboxylic acid copolymer from BASF.

PGNBE: Propylene glycol mono n-butyl ether.

| | A | B | C | D | Tap water | Di water |
|---|---|---|---|---|---|---|
| CAPB | 1.0 | 1.0 | 1.0 | — | — | — |
| AEOS.2EO | — | — | — | 1.0 | | |
| Gluta. | 1.0 | — | — | — | — | — |
| Acusol 460NK | 1.0 | — | — | — | — | — |
| Sokalan HP80 | — | 1.0 | 1.5 | 1.0 | — | — |
| PGNBE/Ethanol (50/50) mix | 3.0 | 3.0 | 3.0 | 3.0 | — | — |
| Water | Bal. | Bal. | Bal. | Bal. | — | — |
| pH | 11.0 | 7.0 | 7.0 | 7.0 | 7.0 | 7.0 |
| Lime scale prevention test | 9 | 9 | 9 | 9 | 1 | 5 |

Lime scale prevention test has been run using samples A to D in Example 2. Composition A is used as reference composition, which contains active ingredients disclosed in U.S. Pat. No. 6,034,046. Tap water having a water hardness of 350 ppm is used as control. A (15×15 cm) black ceramic tile is put on top of a beaker containing boiling water, so as to heat the tile. The enameled ceramic surface is oriented upwards during heating. Tap water is then sprayed on the tile surface using a trigger, while still maintaining the tile on top of said heating beaker. Two trigger strokes are used for covering the whole tile with tap water. Then sample compositions A to D are sprayed immediately afterwards on same tile. Two trigger strokes are delivered on the tile surface. The spraying procedure, namely, two trigger strokes of tap water followed by two trigger strokes of composition, is performed four times on each tile. Between each spraying procedure the tile is left at rest for one minute and rotated for 90 degrees for ensuring a uniform treatment of the tile surface. In control experiments, tap water or demineralized water are used instead of sample compositions A to D in same spraying conditions (four spraying procedures). Tap water rapidly evaporates, leaving a lot of water marks on upper tile surface. The tiles are allowed to cool down to room temperature in vertical position for 30 minutes. Finally each tile is rinsed under running tap water for five seconds, and again allowed to dry vertically. A visual assessment of lime scale prevention ability of tested composition is done by evaluating the shiny aspect of the tile surface, using a 1 to 10 scale. 1 score is for a lot of visible water marks, and corresponds to no prevention properties, while 10 score is ascribed to composition which leads to no visible water marks. Intermediate scores are used to describe intermediate cases.

From the results presented in Example 2, it can be seen that composition B achieves excellent performance when compared to reference composition A. Composition D is at performance parity with reference composition A in neutral pH conditions.

EXAMPLE 3

The following formulas were prepared at room temperature by simple liquid mixing procedures, using the following materials:

CAPB: Cocoamidopropyl dimethyl betaine sold by Albright and Wilson as Empigen BS/CA.

Gluta.: Glutamic acid-N,N-diacetate, sodium salt.

Acusol 460NK: Copolymer of maleic anhydride and olefin sold by Rhom and Haas.

Sokalan HP80: Polyethylene oxide polycarboxylic acid copolymer from BASF.

PGNBE: Propylene glycol mono n-butyl ether.

| | A | B | C |
|---|---|---|---|
| CAPB | 1.0 | 1.0 | 1.0 |
| Gluta. | — | — | 1.0 |
| Acusol 460NK | — | — | 1.0 |
| Sokalan HP80 | 1.0 | 2.0 | — |
| PGNBE/Ethanol (50/50) mix | 3.0 | 3.0 | 3.0 |
| Water | Bal. | Bal. | Bal. |
| pH | 7.0 | 7.0 | 11.0 |
| Lime scale removal test | 79% | 87% | 87% |

Lime scale removal test has been run using sample A to C in Example 3. Composition C is used as reference composition, which contains active ingredients disclosed in U.S. Pat. No. 6,034,046. Clean (15×15 cm) black ceramic tiles are rinsed with demineralized water and dried for six hours in an oven at 60° C. Gloss measurement is performed on each clean tile at room temperature as a baseline, using micro TRI gloss reflectometer from BYK-Gardner GmbH, Germany. The tiles are put in an oven at 150° C. for 30 minutes, and then sprayed five times with a trigger containing hard water having a controlled water hardness of 300 ppm, without removing the tiles from the oven. A time period of 15 minutes is waited before repeating the spraying operation. A total of five cycles [spraying—drying in the oven] is done which leads to a total of 25 trigger strokes per tiles, and approximately 11 to 15 mgr calcium carbonate. Gloss measurement is done on soiled tiles. Lime scale removal evaluation is then performed with Gardner washability test machine from Braive Instruments, Belgium, using sample compositions A to C. A quantity of 2.5 g of neat product is used on wetted sponges in Gardner evaluation. Gloss measurement is finally performed on tiles after cleaning. Results are expressed as lime scale removal percentage, and are calculated from the gloss differences before and after soiling, and before and after cleaning.

From the results presented in Example 3, it can be seen that composition A delivers significant lime scale removal performance. Composition B achieves same lime scale removal performance as reference composition C.

What is claimed is:

1. An anti-lime scale cleaning composition which comprises:

(a) 0.01% to 10% of at least a surfactant, excluding cationic surfactants;

(b) 0.01% to 5% of a polyethylene oxide polycarboxylic acid copolymer having the structure of:

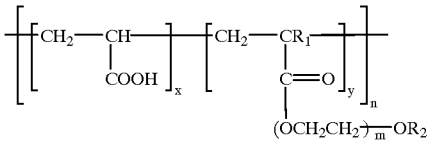

wherein $R_1$ is H or methyl group, $R_2$ is H or an alkyl group having from 1 to 4 carbons, the ratio of x to y is about 8:1 to 10:1, m is about 80 to about 100, the weight ratio of polycarboxylate to polyethylene oxide side chains is about 20/80 and the molecular mass is about 90,000 to about 110,000;

(c) the balance being water wherein the composition does not contain an amino containing polymer, a silicon containing polymer, a nonionic surfactant containing ethoxylate groups, a copolymer of polyvinyl pyrrolidone or polyvinyl pyrridine N-oxide polymers.

2. The composition of claim 1 wherein polyethylene oxide polycarboxylic acid copolymer is acrylic acid-polyethylene glycol monomethyl ether monomethacrylate copolymer sold by BASF under the brand name Sokalan HP80.

3. The composition of claim 1 which contains from 0 to 10% of a zwifterionic surfactant.

4. The composition of claim 1 which contains from 0 to 10% of an anionic surfactant containing an alkyl group.

5. The composition of claim 1 which contains from 0.1 to 10% of a water-mixable cosurfactant having either limited ability or substantially no ability to dissolve oily or greasy soil.

* * * * *